US007306530B2

(12) United States Patent
Connerley

(10) Patent No.: US 7,306,530 B2
(45) Date of Patent: Dec. 11, 2007

(54) ADJUSTABLE HEIGHT BASKETBALL GOAL

(75) Inventor: James J. Connerley, Noblesville, IN (US)

(73) Assignee: Gared Holdings, LLC, Noblesville, IN (US)

( * ) Notice: Subject to any disclaimer, the term of this patent is extended or adjusted under 35 U.S.C. 154(b) by 248 days.

(21) Appl. No.: 11/183,424

(22) Filed: Jul. 18, 2005

(65) Prior Publication Data

US 2007/0015614 A1 Jan. 18, 2007

(51) Int. Cl.
*A63B 63/08* (2006.01)

(52) U.S. Cl. ..... 473/483; D21/701

(58) Field of Classification Search ..... 473/479–483; 248/201, 686, 688, 570, 580, 637; D21/701
See application file for complete search history.

(56) References Cited

U.S. PATENT DOCUMENTS

| | | | | | |
|---|---|---|---|---|---|
| 2,916,288 | A * | 12/1959 | Chervenka | ..... | 473/482 |
| 4,395,040 | A * | 7/1983 | White | ..... | 473/484 |
| 4,588,188 | A * | 5/1986 | Mahoney et al. | ..... | 473/481 |
| 4,643,422 | A | 2/1987 | Cramblett | | |
| 4,895,365 | A * | 1/1990 | Schroeder | ..... | 473/481 |
| 4,941,661 | A * | 7/1990 | Lykens | ..... | 473/483 |
| 4,948,127 | A | 8/1990 | Willard | | |
| 5,102,127 | A | 4/1992 | Pohrer | | |
| 5,114,141 | A | 5/1992 | Mahoney | | |
| 5,279,496 | A | 1/1994 | Schroeder | | |
| 5,601,284 | A | 2/1997 | Blackwell et al. | | |
| 5,800,296 | A | 9/1998 | Shaw | | |
| 5,947,849 | A | 9/1999 | Ellenbaum | | |
| 6,056,654 | A | 5/2000 | Schroeder | | |
| 6,283,878 | B1 | 9/2001 | White | | |
| 6,368,240 | B1 * | 4/2002 | Pohrer | ..... | 473/483 |
| 6,537,162 | B1 | 3/2003 | Schroeder | | |
| 6,802,790 | B2 | 10/2004 | Pohrer | | |
| 6,824,481 | B1 * | 11/2004 | Nye et al. | ..... | 473/481 |

* cited by examiner

*Primary Examiner*—Eugene Kim
*Assistant Examiner*—M. Chambers
(74) *Attorney, Agent, or Firm*—Brinks Hofer Gilson & Lione

(57) ABSTRACT

Laterally extending upper and lower backboard bracing members are coupled to a vertically movable framework, the bracing members including ends coupled to corner brackets of a peripheral frame surrounding a backboard. A yoke member has a central plate coupled to a back face of the backboard in alignment with a basket assembly. The yoke member includes horizontal webs fixed to the central plate defining outwardly extending arms having terminal ends including rearwardly extending tabs coupled to the lower backboard bracing member at locations laterally outward spaced from the central plate.

17 Claims, 5 Drawing Sheets

ADJUSTABLE HEIGHT BASKETBALL GOAL

BACKGROUND OF THE INVENTION

The present invention relates to basketball goals, consisting generally of a basket, backboard and support, which are vertically adjustable in position. The present invention relates particularly to such a goal that can be mounted on a single depending vertical support U.S. Pat. Nos. 2,916,288; 4,643,422 and 5,947,849 disclose vertically adjustable basketball goals movably mounted on a spaced pair of vertically depending supports. Tubular or channel-shaped members joined together by a cross member slide vertically on the supports in response to rotation of a screw drive engaging a nut on the cross member. The basket ball backboard is mounted via a suitable framework to the tubular members, and the basket is mounted to the backboard. The support of the basket is dependent entirely on the strength of the board. A similar structure is to be found in U.S. Pat. No. 5,102,127.

U.S. Pat. No. 4,395,040 discloses a vertically adjustable basketball goal movably mounted on a parallelogram supporting structure connected at one end to a supporting post. The second end of the parallelogram structure is fixed to the backboard and basket. Vertical movement of the basketball goal is achieved with a screw drive that changes the angular relationship of the members forming the parallelogram structure. The movement of the basket ball goal is not merely vertical, but follows an arc defined by the radius arms of the parallelogram structure. A similar structure having a step-wise adjustment mechanism instead of the screw drive is disclosed in U.S. Pat. No. 6,283,878.

U.S. Pat. No. 4,941,661 discloses a vertically adjustable basketball goal secured to horizontally extending arms protruding from an elongate slotted channel member secured to a single support cylinder. A movable member within the slotted channel member is engages a screw drive that can move the movable member vertically within the channel member. Diagonal bracing members extend upward from the movable member to an upper portion of the backboard. The support for the laterally outer portions of the backboard is provided entirely by the backboard itself.

U.S. Pat. No. 4,948,127 discloses a vertically adjustable basketball goal secured to a frame including a pair of vertically oriented inner guide tubes connected together by a horizontal cross member. The inner guide tubes slide within a pair of outer guide tubes that are secured to horizontally extending brackets designed to be coupled to a suitable support. A threaded nut on the horizontal cross member of the goal frame engages a threaded screw drive that can move the goal frame vertically with respect to the outer guide tubes. The basket is connected to the lower end of a vertical member included in the frame.

U.S. Pat. Nos. 5,279,496, 6,056,654, and 6,537,162 disclose an adjustable backboard that is fixed to a vertically extending U-shaped bracket that is co-extensive with the height of the board. The basket is connected directly through the backboard to the lower end of the U-shaped bracket. Additional brackets extending laterally outward from the U-shaped bracket are fixed to an upper portion of the back board, but no corresponding lateral support is provided near the lower end. A pair of slides is fixed to the sides of the U-shaped bracket. The pair of slides engages a vertically extending framework, suitable for connection to a support, which includes a horizontal member including a threaded nut. A threaded screw drive extends between the lower end of the U-shaped bracket and the horizontal member of the framework. The direct connection between the U-shaped bracket and the basket is said to provide improved support for the basket. A similar structure, omitting the laterally extending brackets near the upper portion of the backboard is to be found in U.S. Pat. No. 5,800,296. Another similar structure that replaces the U-shaped bracket with a rectangular stem received within a rectangular tube is shown in U.S. Pat. Nos. 6,368,240 and 6,802,790.

It has been observed, however, that the forgoing designs often rely on the inherent strength of the board for support of the basket in relation to the underlying frame, and often provide no lateral support for the lower lateral margins of the backboard. This can result in a backboard structure that has limited strength and uneven, unpredictable rebound characteristics. Such a backboard can experience vibration causing loosening of bolts and nuts and even metal fatigue. What is needed is a vertically movable backboard support structure that provides sufficient reinforced connection between the basket and the vertically movable support structure, while at the same time provides for enhanced lateral support for the backboard.

SUMMARY OF THE INVENTION

These several needs are satisfied by an adjustable height basketball goal that includes a backboard having a peripheral frame. A vertically movable framework is provided including a drive for moving the framework relative to a supporting standard. Laterally extending upper and lower backboard bracing members are coupled to the peripheral frame adjacent to lateral outer edges of the peripheral backboard frame and to the vertically movable framework. A yoke member has a central plate coupled to the backboard, and a basket is coupled to the central plate through the backboard. The yoke member has outwardly extending arms including terminal ends coupled to the lower backboard bracing member. The terminal ends of the outwardly extending arms are separated from each other by a distance that is at least about twice the width of the central plate. The terminal ends of the outwardly extending arms can be located outside the vertically extending framework. The terminal ends of the outwardly extending arms can also be located outside an outer edge of the basket.

The basket can be coupled to the central plate of the yoke member adjacent an upper margin of the central plate, while a lower margin of the central plate can be coupled to the backboard peripheral frame. The backboard peripheral frame can include corner brackets to which the laterally extending upper and/or lower backboard bracing members can be coupled. The lower backboard bracing member can be coupled to a lower horizontal member of the vertically movable framework. The yoke member can be formed by upper and lower horizontal webs fixed to the central plate, the webs being separated by a vertical distance that is greater than the vertical dimension of the lower horizontal backboard bracing member. The yoke member can include rearwardly extending tabs at the yoke terminal ends, the tabs including apertures for receiving a fastener passing vertically through the lower backboard bracing member.

One feature of the present invention is the presence of a yoke member that connects to the goal basket through the back board, and connects to a lower horizontal backboard bracing member at a position spaced laterally outwardly from the goal basket assembly to improve the support of the basket separate from any inherent backboard strength. This feature has the advantage of improving the overall strength of the goal by about 15% over prior designs, and provides for a more stable backboard without any discernable dead spots.

The. Other features of the present invention and the corresponding advantages of those features will be come apparent from the following discussion of a preferred embodiment of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
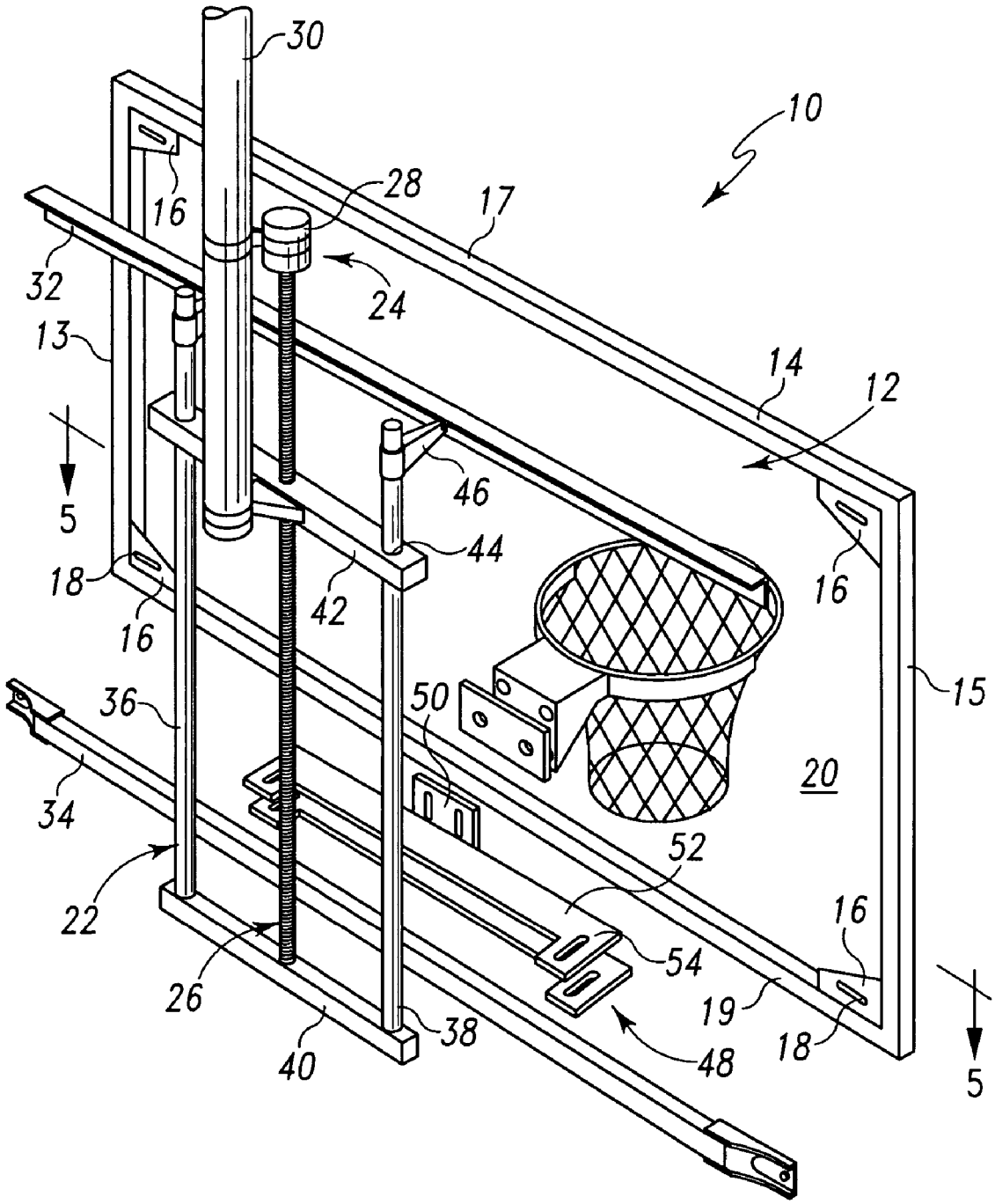
FIG. 1 is an exploded, rear perspective view of an adjustable height basketball goal of the present invention.
Figure 6:
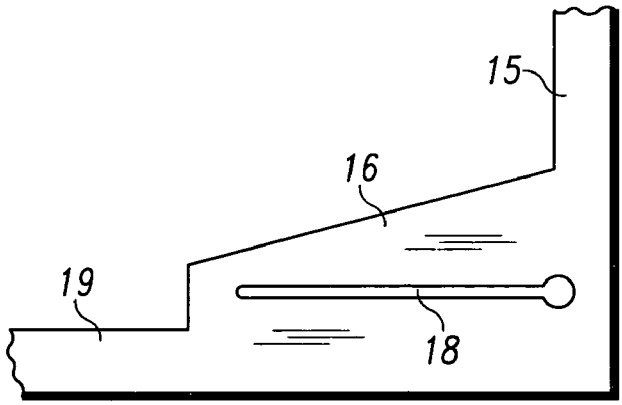
FIG. 6 is a detail elevation view of a corner gusset suitable for engagement with a backboard bracing member.

An adjustable height basketball goal 10 of the present invention is shown in FIG. 1 to include a backboard 12 having a peripheral frame 14. The backboard 12 is shown to be made of glass or other transparent material that will permit spectators seated behind the backboard 12 to visualize the actions of the players and ball during a game. The frame 14 can be made in a well-known manner of metal, such as steel, to include side members 13 and 15 joined by top and bottom horizontal members 17 and 19. A corner gusset 16, which can include at least one mounting aperture 18, can be included at each corner of the frame 14 behind a back surface 20 of the backboard 12. A particularly advantageous corner gusset 16 is shown in FIG. 6. A vertically movable framework 22 can include a drive 24, which can take the form of a screw threaded shaft 26. The shaft 26 can be rotated either by hand or with the aid of a suitable motor 28 for moving the framework 22 relative to a supporting standard 30. While the standard 30 is shown be a depending singular member, the standard can include two or more vertical members and can be floor supported instead of being suspended from some overhead structure.

Laterally extending upper and lower backboard bracing members 32 and 34, respectively, are coupled to the peripheral frame 14 adjacent to the side members 13 and 15. The backboard bracing members 32 and 34 can be connected to the corner gussets 16. This can be accomplished using suitable fasteners, such as bolts, that protrude backward from the corner gussets 16 to engage openings 33 in the ends 35 of the backboard bracing members as shown in detail in FIG. 2. The backboard bracing members 32 and 34 are also coupled to the vertically movable framework 22. The vertically movable framework 22 can take the form of two vertical members 36 and 38 that are tied together by lower horizontal member 40. An upper horizontal member 42 can be fixed to the standard 30 or other supporting structure. The upper horizontal member 42 can include openings 44 through which the vertical members 36 and 38 can slide in response to rotation of the drive shaft 26. The upper backboard bracing member 32 can be coupled to the vertical members 36 and 38 by arms 46. The lower backboard bracing member 34 can be secured to the lower horizontal member 40 with suitable fasteners or other coupling mechanisms. Other vertically movable frameworks can be substituted for the illustrated framework 22.

Figure 2:
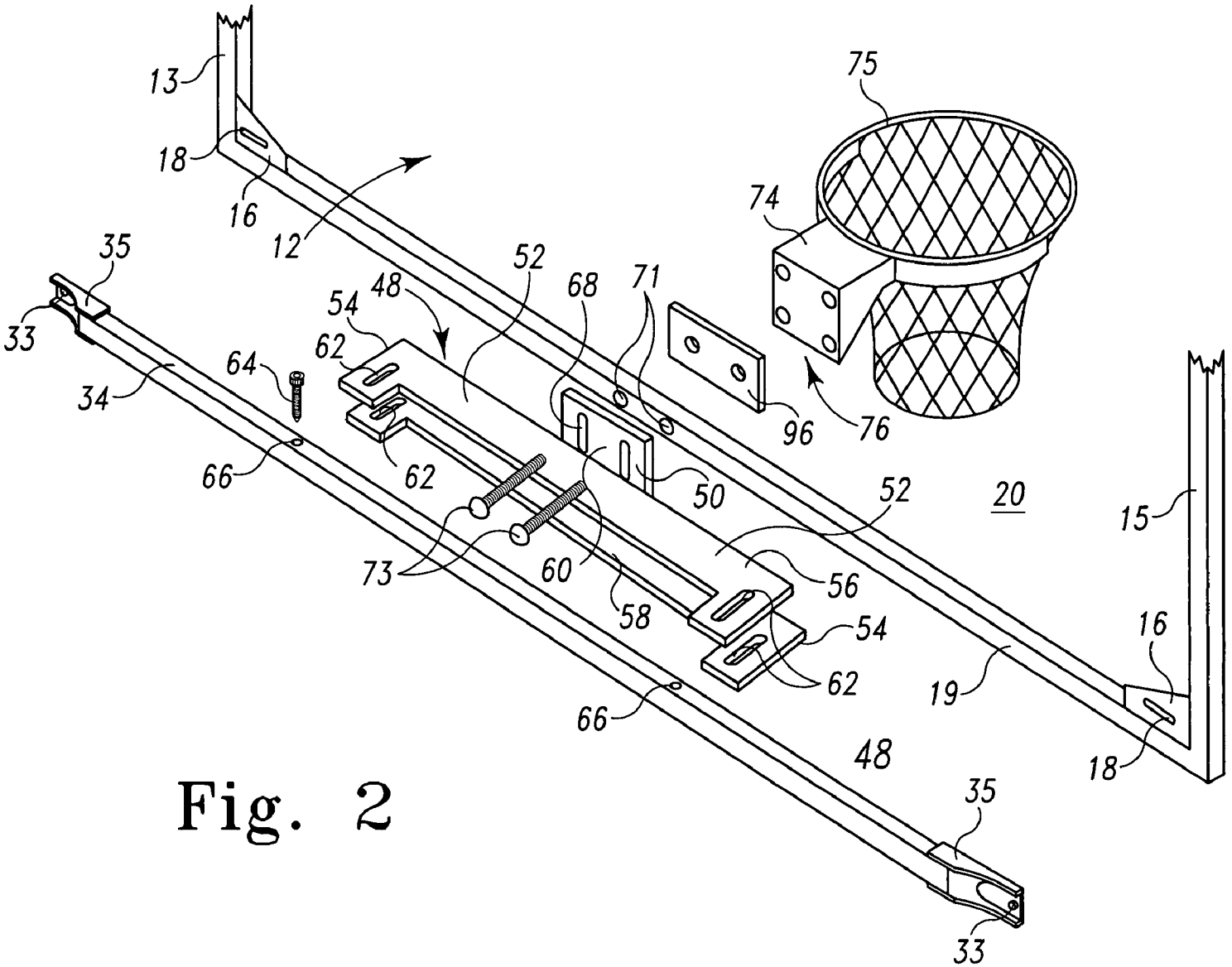
FIG. 2 is a rear perspective detail of portions of the present invention.
Figure 3:
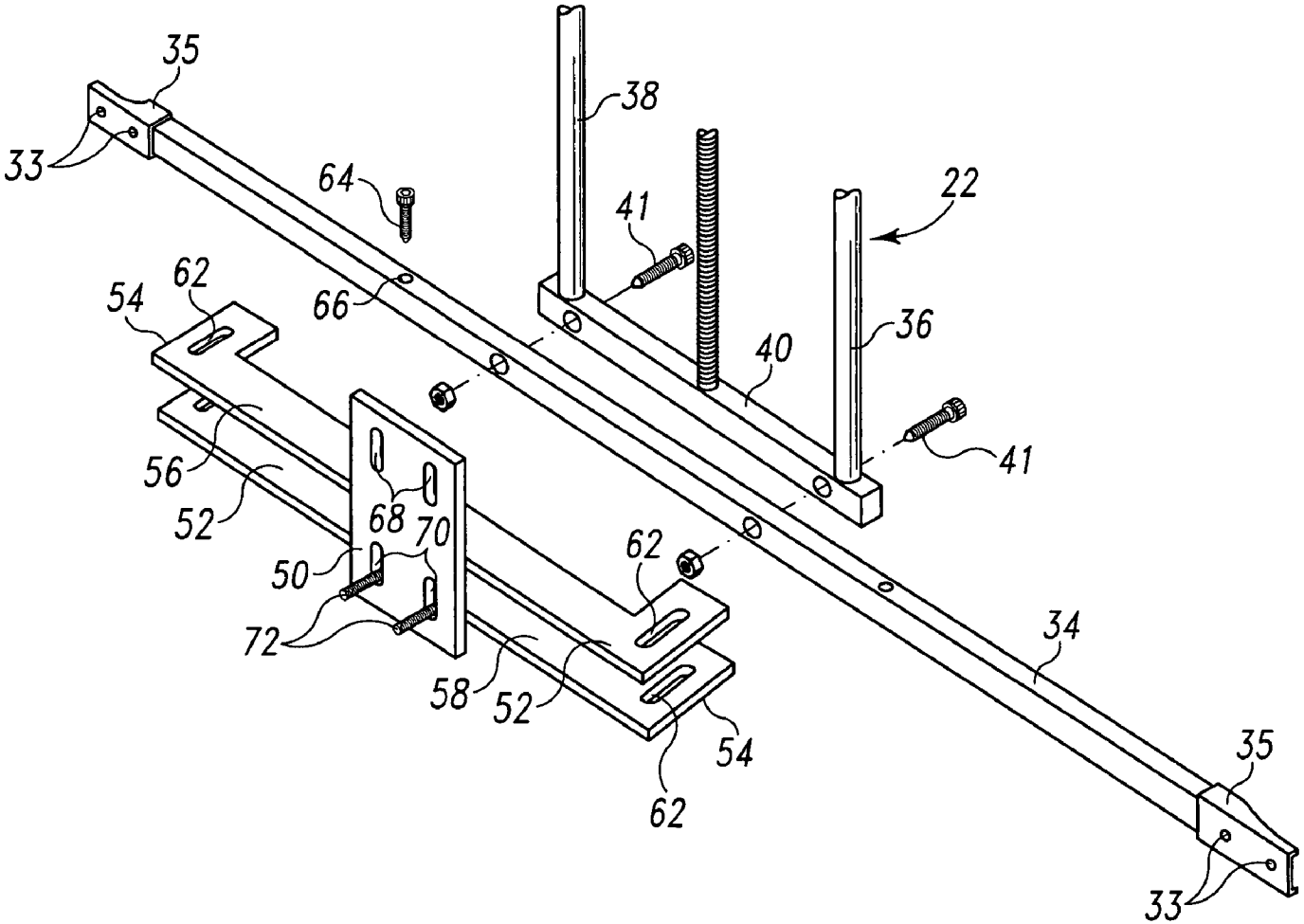
FIG. 3 is a front perspective detail of portions of the present invention.

A yoke member 48, shown in greater detail in FIGS. 2 and 3, has a central plate 50 and outwardly extending arms 52 that include terminal ends 54. The terminal ends 54 of the outwardly extending arms 52 can be laterally separated from each other by a distance of at least about twice the width of the central plate 50. The outwardly extending arms 52 can be defined by a pair of vertically separated parallel horizontal plate members 56 and 58 that are fixed, for example by welding, to a back surface 60 of the central plate 50. The vertical separation between the horizontal plate members 56 and 58 can be, for example, about the vertical dimension of the lower backboard bracing member 34. When so spaced, the terminal ends 54 of the horizontal plate members 56 and 58 can be positioned to straddle vertically the lower backboard bracing member 34. The terminal ends 54 can be in the form of rearwardly extending tabs that can include openings 62 for receiving fasteners 64 that also can pass through a suitable opening 66 in the lower backboard bracing member 34. The terminal ends 54 of the outwardly extending arms 52 can be coupled to the lower backboard bracing member 34 laterally outside the location of the vertical members 36 and 38 of the vertically movable framework 22. The lower backboard bracing member 34 can be secured to the lower horizontal member 40 of the vertically movable framework 22 by suitable fasteners 41, such as screws or bolts as shown in FIG. 3.

Figure 4:
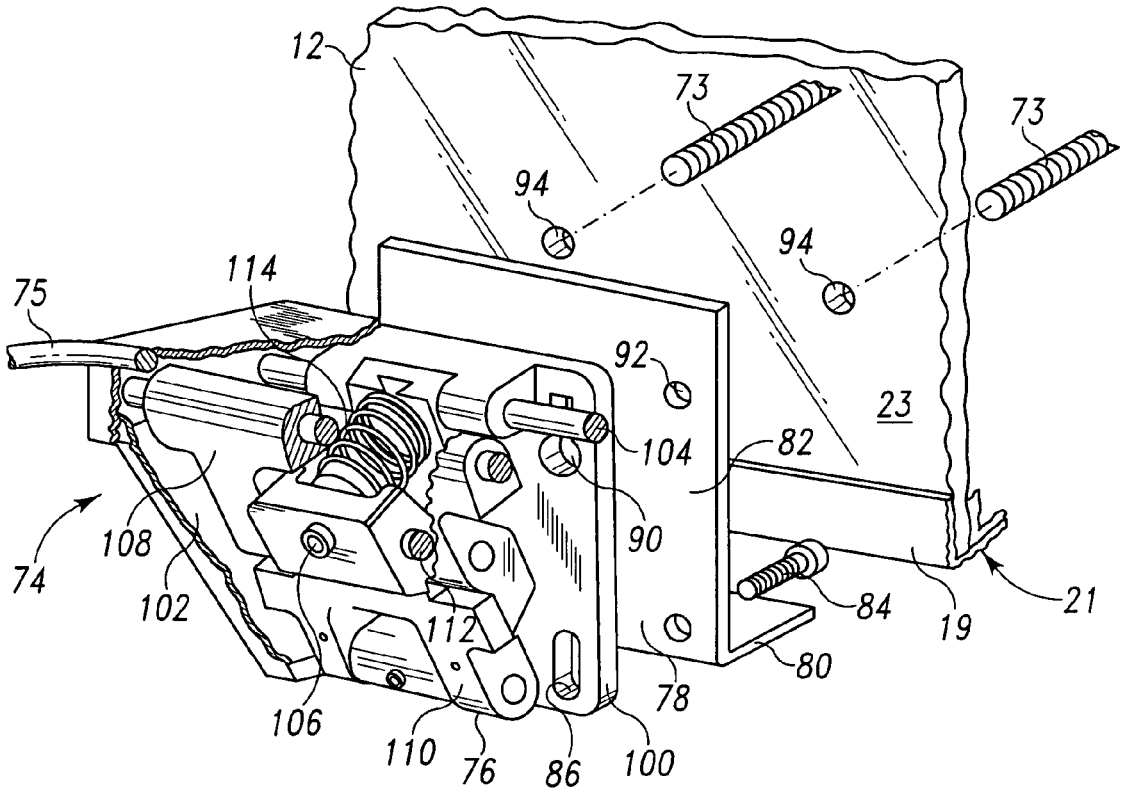
FIG. 4 is a perspective view of a rim support assembly that can be used with the present invention.

The central plate 50 of the yoke member 48 can include an upper pair of openings 68 shown in FIG. 2 and a lower pair of openings 70 as shown in FIG. 3. Suitable fasteners 72 can pass through the lower pair of openings 70 into receiving openings 71 in the bottom horizontal member 19 of the backboard frame 14. The upper pair of openings 68 can receive fasteners 73 that are used to fasten an upper portion of a rim support assembly 74 to the backboard 12. A suitable rim support assembly 74 is shown in FIGS. 2 and 4 to have a goal rim 75 and a breakover release mechanism 76, such as that found in U.S. Pat. No. 5,318,289, which is hereby incorporated by reference. The breakover release mechanism 76 generally includes a supporting base 100 that is fixed to the backboard 12 by fasteners received through openings 86 and 90. The goal rim 75 is secured to a connector housing 102, which is pivotally connected to the supporting base 100 by a pivot pin 104. A breakover actuator assembly 106 also connects the supporting base 100 and to the connector housing 102. The breakover actuator assembly 106 includes an upper arm 108 and lower arm 110 that are pivotally connected together by pivot pin 112. A spring member 114 mounted between the breakover actuator assembly 106 and the supporting base 100 maintains the goal rim 75 at the desired horizontal position until pressure in excess of a specified amount is applied, in which case the goal rim 75 and connector housing 102 is permitted to pivot about pivot pin 104 to alleviate pressure on the backboard 12. Other goal rim support assemblies can be used in place of that shown in FIG. 4.

Figure 7:
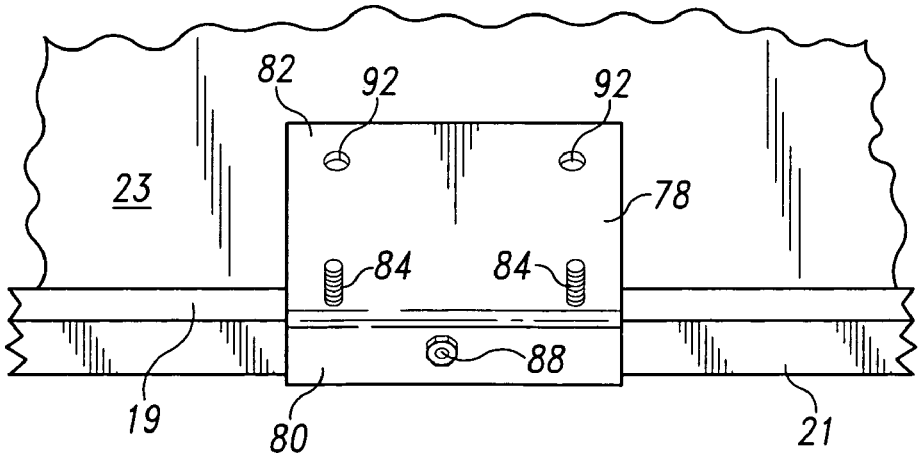
FIG. 7 is a perspective view of the bottom and front side of a backboard useable in the present invention.

The rim support assembly 74 can be mounted on the basketball backboard 12 through an intermediate L-shaped base support 78 shown in FIGS. 4 and 7. A bottom flange 80 of the base support 78 can be secured to the lower surface 21 of the bottom horizontal frame member 19 by a suitable fastener 88, while the upright flange 82 can be positioned substantially flush with the front surface 23 of the backboard 12. The breakover release mechanism 76 can be fixed to the L-shaped base support 78 by fasteners 84 extending outward from a lower portion of the L-shaped base support 78 through openings 86. The fasteners 73 that secure the yoke plate 50 to the back of the backboard 12 can extend through the upper openings 90 in the rim support assembly 74, which align with openings 92 in the base support 78 and corresponding openings 94 in the backboard 12. An impact distribution plate 96, shown in FIGS. 2 and 5, can be secured to the back surface 20 of the backboard 12 by nuts or similar elements that engage the fasteners 73 between the impact distribution plate 96 and the central yoke plate 50. The fasteners 73 can also penetrate through the upper openings 68 of the central yoke plate 50 so that the yoke plate 50 is coupled through the backboard 12 to the rim support assembly 74.

Figure 5:
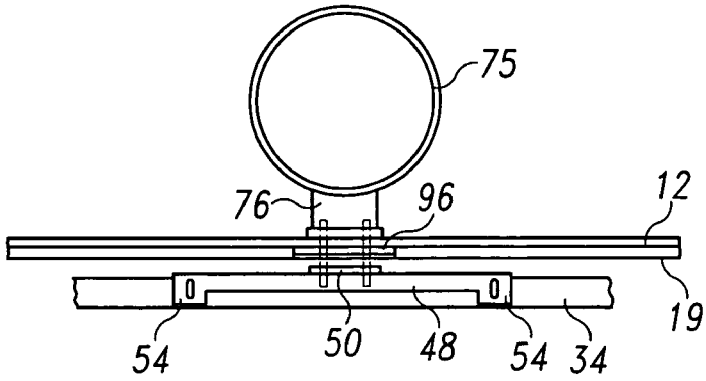
FIG. 5 is a sectional view taken along line 2-2 of FIG. 1.

The coupling of the rim supporting assembly 74 through the backboard 12 to the yoke plate 50 on yoke member 48 assures an enhanced lateral distribution of the forces acting on the rim 75 as they are transmitted to a backboard bracing member 34, which is coupled to the lateral outer margins 13 and 15 of the backboard 12. The outwardly extending arms 52 of the yoke member 48 have included terminal ends 54 coupled to the backboard bracing member 34 at a widely spaced position. The terminal ends 54 of the outwardly extending arms 52 can be separated from each other by a distance sufficient to position the coupling between the arms 52 and the bracing member 34 outside an outer edge of the basket rim 75 as shown in FIG. 5. This lateral distribution of the forces acting on the rim 75 improves the support and stability of the basket separate from any inherent backboard strength.

While these features have been disclosed in connection with the illustrated preferred embodiment, other embodiments of the invention will be apparent to those skilled in the art that come within the spirit of the invention as defined in the following claims.

What is claimed is:

1. An adjustable height basketball goal comprising: a backboard having an peripheral frame, a vertically movable framework including a drive for moving the framework relative to a supporting standard, laterally extending upper and lower backboard bracing members coupled to the peripheral frame adjacent to side edges of the frame, the bracing members being coupled to the vertically movable framework, a yoke member having a central plate coupled to the backboard and rearwardly extending tabs at the yoke terminal ends, the tabs including apertures for receiving a fastener passing vertically through the lower backboard bracing member, a basket coupled to the central plate through the backboard, and outwardly extending arms of the yoke member having terminal ends coupled to the lower backboard bracing member outside the vertically movable framework.

2. The adjustable height basketball goal of claim 1 wherein the peripheral frame includes corner brackets, the upper and lower backboard bracing members being coupled to the corner brackets.

3. The adjustable height basketball goal of claim 1 wherein the vertically movable framework includes a lower horizontal member, and the lower backboard bracing member is coupled to the lower horizontal member of the vertically movable framework.

4. The adjustable height basketball goal of claim 1 wherein the central plate of the yoke member includes an upper margin and a lower margin, and a basket is coupled to the central plate of the yoke member adjacent the upper margin of the central plate, the lower margin of the central plate being coupled to the backboard peripheral frame.

5. The adjustable height basketball goal of claim 4 wherein the yoke member comprises upper and lower horizontal webs fixed to the central plate, the webs being separated by a vertical distance that is greater than the lower backboard bracing member vertical dimension.

6. The adjustable height basketball goal of claim 4 further comprising an L-bracket positioned between the basket and the backboard and coupled to the peripheral frame.

7. An adjustable height basketball goal comprising: a backboard having an peripheral frame with lateral outer edges, a vertically movable framework including a drive for moving the framework relative to a supporting standard, laterally extending upper and lower backboard bracing members coupled to the peripheral frame adjacent to lateral outer edges of the peripheral frame, the bracing members being coupled to the vertically movable framework, a basket assembly coupled to a front face of the backboard, the basket assembly including a horizontal rim having a lateral outermost dimension, a yoke member having a central plate coupled to a back face of the backboard in alignment with the basket assembly, the yoke member including outwardly extending arms having terminal ends, and rearwardly extending tabs at the yoke terminal ends, each tab including an aperture receiving a fastener passing vertically through the lower backboard bracing member coupled to the lower backboard bracing member outside the lateral outermost dimension of the basket rim.

8. The adjustable height basketball goal of claim 7 wherein the yoke member comprises upper and lower horizontal webs fixed to the central plate, the webs being separated by a vertical distance that is greater than the lower backboard bracing member vertical dimension.

9. The adjustable height basketball goal of claim 7 wherein a first set of fasteners located adjacent an upper margin of the central plate of the yoke member couple the central plate to the basket assembly through the backboard, and a second set of fasteners couple a lower margin of the central plate to the backboard peripheral frame.

10. The adjustable height basketball goal of claim 9 further comprising an L-bracket positioned between the basket assembly and the backboard front face, a lower margin of the L-bracket being coupled to the peripheral frame.

11. The adjustable height basketball goal of claim 8 wherein said peripheral frame includes corner brackets, the upper and lower backboard bracing members including ends coupled to the corner brackets.

12. The adjustable height basketball goal of claim 11 wherein the vertically movable framework includes a lower horizontal member coupled to said drive, the lower backboard bracing member being coupled to the lower horizontal member of the vertically movable framework.

13. An adjustable height support for a basketball goal comprising: a vertically movable framework including a drive for moving the framework relative to a supporting standard, laterally extending upper and lower backboard bracing members coupled to the vertically movable framework, the upper and lower backboard bracing members including ends adapted to be coupled to corner brackets of a peripheral frame surrounding a backboard, and a yoke member having a central plate adapted to be coupled to a back face of the backboard in alignment with a basket assembly, the yoke member including outwardly extending arms having terminal ends including rearwardly extending tabs coupled to the lower backboard bracing member, each of the yoke member rearwardly extending tabs including an aperture receiving a fastener passing vertically through the lower backboard bracing member.

14. The adjustable height support of claim 13 wherein the yoke member comprises upper and lower horizontal webs fixed to the central plate, the webs being separated by a vertical distance that is greater than the lower backboard bracing member vertical dimension.

15. The adjustable height support of claim 13 wherein the vertically movable framework includes a lower horizontal member coupled to said drive, the lower backboard bracing member being coupled to the lower horizontal member of the vertically movable framework.

16. The adjustable height support of claim 15 wherein the vertically movable framework includes an upper member adapted to be fixed to said supporting standard, the upper member engaging the drive and providing slide bearing surfaces assuring alignment of the movable framework during vertical movement.

17. The adjustable height support of claim 16 further comprising vertically extending slide members engaging the slide bearing surfaces of the upper member, and coupling members connecting said upper backboard bracing member to the vertically extending slide members.

* * * * *